US007125296B2

(12) United States Patent
Yazaki et al.

(10) Patent No.: US 7,125,296 B2
(45) Date of Patent: Oct. 24, 2006

(54) FORWARD/BACKWARD GEAR SHIFTING MECHANISM FOR OUTBOARD ENGINE

(75) Inventors: Makoto Yazaki, Wako (JP); Tsuyoshi Yoshigasa, Wako (JP); Toru Kimura, Wako (JP); Yoshiyuki Matsuda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 122 days.

(21) Appl. No.: 10/877,069

(22) Filed: Jun. 25, 2004

(65) Prior Publication Data

US 2005/0003717 A1 Jan. 6, 2005

(30) Foreign Application Priority Data

Jun. 25, 2003 (JP) ..... 2003-181383
Jun. 25, 2003 (JP) ..... 2003-181384
Jun. 25, 2003 (JP) ..... 2003-181385
Jun. 25, 2003 (JP) ..... 2003-181386

(51) Int. Cl.
*B63H 23/00* (2006.01)

(52) U.S. Cl. ..... 440/75

(58) Field of Classification Search ..... 440/75
See application file for complete search history.

(56) References Cited

U.S. PATENT DOCUMENTS 4,403,970 A * 9/1983 Dretzka et al. ..... 440/75
4,525,149 A 6/1985 Broughton et al.
5,910,191 A * 6/1999 Okamoto ..... 74/473.14
6,238,255 B1 * 5/2001 Takase ..... 440/1
6,416,367 B1 7/2002 Goebel
2003/0224672 A1 * 12/2003 Takada et al. ..... 440/75

FOREIGN PATENT DOCUMENTS

JP 08-091296 4/1996
JP 09-123996 5/1997

* cited by examiner

*Primary Examiner*—Ed Swinehart
(74) *Attorney, Agent, or Firm*—Carrier, Blackman & Associates, P.C.; Joseph P. Carrier; William D. Blackman

(57) ABSTRACT

A forward/backward gear shifting mechanism for an outboard engine includes an operating cable passed through an outer pipe fixed to a bracket attached to an under cover and extended into an engine room, a shift rod for shifting a forward/backward gear, a driving arm for turning the shift rod, and a transmission mechanism linked to the operating cable to transmit operating force to the driving arm. The transmission mechanism includes an arm mechanism including an input arm, an output arm and a pivotal shaft and supported for turning about a fixed rotational axis by support members on the engine unit. The operating cable is linked to the input arm of the transmission mechanism by a slider, i.e., a linking member. A first connecting member connecting the input member and the slider is nearer to the bracket than a second connecting member connecting the operating cable and the slider. A necessary stroke of the operating cable is secured, choices of disposing the transmission mechanism are increased, the lightness of a shifting operation is improved, and the transmission mechanism is compact.

18 Claims, 7 Drawing Sheets

FORWARD/BACKWARD GEAR SHIFTING MECHANISM FOR OUTBOARD ENGINE

CROSS-REFERENCE TO RELATED APPLICATIONS

The present application claims priority under 35 U.S.C. 119, based on each of the following patent applications:

Japanese Patent Application No. 2003-181383, filed on Jun. 25, 2003;

Japanese Patent Application No. 2003-181384, filed on Jun. 25, 2003;

Japanese Patent Application No. 2003-181385, filed on Jun. 25, 2003; and

Japanese Patent Application No. 2003-181386, filed on Jun. 25, 2003.

BACKGROUND OF THE INVENTION

1. Field of the Invention

The present invention relates to a forward/backward gear shifting mechanism provided with a selector rod for selectively shifting a forward/backward selector included in a propulsion unit of an outboard engine.

2. Description of the Related Art

A marine propulsion machine has a propulsion unit driven by an engine and including a propeller. The propulsion unit includes a forward/backward gear. A shift rod is operated by a remote control device using an operating cable to shift the forward/backward gear to either a forward-drive position or a backward-drive position.

An outboard engine disclosed in JP 9-123996 A has a shift link connected to a remote control cable with a pin that slides along a guide groove formed in a guide attached to an exhaust guide, and a shift arm connected to the shift link with a pin and fastened to a shift rod. Shifting force is transmitted through the remote control cable extending from a remote controller, the pin and the shift link to the shift arm to the shift rod to drive the shift rod.

In this known outboard engine, the joint of the remote control cable and the pin, and the joint of the pin and the shift link are at the same position with respect to a longitudinal direction from a cable holding part at which the remote control cable is held on a bracket. Therefore, the position of the shift link is decided uniquely when a stroke for which the remote control cable needs to be moved to move the shift link is determined. Thus, there is a restriction on the position of the shift link.

An outboard engine disclosed in JP 8-91296 A is provided, to drive a shift rod in a remote control mode, with an input shift arm fastened to a shaft supported for turning on a bracket fastened to a crankcase, an output shift arm fixed to the upper end of an output shift shaft supported for turning on the crankcase, a shift link connecting the input shift arm and the output shift arm, a driving sector gear attached to the lower end of the output shift shaft, and a driven sector gear attached to the upper end of the shift rod and engaged with the driving sector gear. Operating force applied to a shift lever by an operator to change the position of the shift rod is transmitted through a Bowden cable connected to the shift lever to the input shift arm. The motion of the input shift arm is transmitted through the shift link, the output shift arm and the driving sector gear to the driven sector gear to drive the shift rod.

Each of the outboard engines described in JP 9-123996 A and JP 8-91296 A is provided with a linkage including the shift link to drive the shift rod by the operating force. In the outboard engine disclosed in JP 8-91296 A, the shift link connecting the input and the output shift arm needs to turn relative to the input and the output shift arm and hence some clearances are formed in the joints of the shift link, and the input and the output shift arm. The clearances cause a time lag between the motion of the input shift arm turned by the cable and the motion of the output shift arm moved by the shift linkage. Consequently, the relation between the operating position of the operating member and the selected position of the shift rod is not always fixed and the operator is unable to obtain a satisfactory shift feeling.

In each of the outboard engines disclosed in JP 9-123996 A and JP 8-91296 A, the shift link performs both a translating motion and a turning motion and hence a comparatively wide space must be available for the motion of the shift link. Thus, it is difficult to install the linkage in a narrow space, restrictions are placed on the arrangement of the members related with the shift link and it is difficult to arrange the associated members compactly.

In the outboard engine disclosed in JP 8-91296 A, the Bowden cable is fastened to the input shift arm. Therefore, the Bowden cable is curved and resistance against the sliding movement of the Bowden cable increases when the input shift arm is turned. Consequently, the lightness of the shifting operation is spoiled.

The outboard engine disclosed in JP 8-91296 A is provided, to operate the shift rod in a remote control mode, with the input shift arm fastened to the input shift shaft, the output shift arm fixed to the upper end of the output shift shaft, the shift link connecting the input shift arm and the output shift arm, the driving sector gear attached to the lower end of the output shift shaft, and the driven sector gear attached to the upper end of the shift rod and engaged with the driving sector gear. Operating force applied to the shift lever by the operator to operate the shift rod is transmitted through the Bowden cable connected to the shift lever to the input shift arm, and from the input shift arm through the shift link, the output shift arm, the driving sector gear and the driven sector gear to drive the shift rod. The output shift arm has a depression that receives a roller supported on the extremity of a leaf spring, and a dog for operating a limit switch to send out a neutral-indicating signal.

In the outboard engine disclosed in JP 8-91296 A, a rotational axis about which the output shift arm provided with the dog turns is on a line parallel to the moving direction of the actuator, which moves to close and open the contact of the limit switch. There is not any choice of determining the position of the limit switch, the dog having a length from the rotation axis needs to turn in a wide turning range to move the actuator properly. Thus, it is difficult to form a shifting device provided with such a limit switch in compact construction.

The leaf spring that creates a click to enable the operator to recognize the shift of the shift rod to a neutral position, and the dog for operating the limit switch are separate members. Therefore, in some cases, the detection of the shift of the shift rod to the neutral position and operator's perception of a click do not occur simultaneously.

The need to position the leaf spring so that the resilience of the leaf spring may not affect the turning motion of the output shift arm places restrictions on the placement of the leaf spring and the limit switch, making it difficult to form the forward/backward gear shifting mechanism in compact construction.

In the outboard engine disclosed in JP 8-91296 A, the Bowden cable passed through the wall of the under case has one end connected the input shift arm and the other end connected to the shift lever disposed at a distance from the outboard engine. The operating force applied by the operator to change the propulsion mode is transmitted through the Bowden cable connected to the shift lever, the input shift arm, the shift link, the output shift arm, the driving sector gear and the driven sector gear to the to the shift rod.

In the outboard engine disclosed in JP 8-91296 A, the rotational axis of the driving sector gear in mesh with the driven sector gear lies on a longitudinal straight line passing a steering axis. Therefore, the distance between the rotational axis of the input shift 14m and that of the driving sector gear is long, the input shift arm, the shift link, the output shift arm and the driving sector gear occupy a large space, and hence the outboard engine is large.

The present invention has been made in view of the foregoing problems and it is therefore an object of the present invention to provide a forward/backward gear shifting mechanism for an outboard engine, capable of securing a necessary stroke of an operating cable, of increasing choices of disposing a transmission mechanism and of being lightly operated for a propulsion mode changing operation. Another object of the present invention is to increase choices of disposing a pivot shaft regardless of the position of the joint of an operating cable and a linking member.

A further object of the present invention is to provide a forward/backward gear shifting mechanism for an outboard engine, capable of producing an improved shift feel, including a compact transmission mechanism, of increasing choices of disposing the transmission mechanism, and of improving operating lightness.

A still further object of the present invention is to provide a forward/backward gear shifting mechanism for an outboard engine, capable of increasing choices of disposing a neutral-indicating switch, of being formed in compact construction, and of eliminating time lag between the detection of the shift of a shift rod to a neutral position and operator's perception of a click.

An additional object of the present invention is to provide a forward/backward gear shifting mechanism provided with a compact transmission mechanism for transmitting an operating force applied to an operating cable to a driving member for driving a shift rod, capable of being highly lightly operated, of producing an improved shift feel, and of increasing choices of disposing the transmission mechanism.

SUMMARY OF THE INVENTION

The present invention provides a forward/backward gear shifting mechanism for an outboard engine including: an operating cable passed through an outer pipe fixed to a stationary member of an engine unit included in the outboard engine tiltable about a tilting axis, the operating cable extending from an external position in front of the engine unit into the engine unit to transmit operating force applied to an operating member disposed outside the engine unit; a shift rod for shifting a forward/backward gear included in a propulsion unit; a driving member operatively connected to the shift rod to drive the shift rod; and a transmission mechanism linked to the operating cable to transmit the operating force to the driving member; wherein the transmission mechanism includes an input member that receives the operating force from the operating cable, the operating cable is connected to the input member of the transmission mechanism by a linking member, a first connecting member connecting the input member and the linking member is nearer to the stationary member than a second connecting member connecting the operating cable and the linking member.

Since the connecting member connecting the operating cable and the linking member can be positioned at a long distance from the stationary member, a necessary longitudinal stroke can be secured without shifting the stationary member forward and the operating cable will not be excessively bent in front of the engine unit even if the engine unit is tilted at a large angle. Hence, the increase of resistance against the operation of the operating cable due to the bending of the operating cable can be avoided. The position of the first connecting member connecting the input member and the linking member is not dependent on the position of the second connecting member connecting the operating cable and the linking member, and the distance between the two connecting members can be changed. Therefore, the transmission is adaptable to spaces respectively having various different shapes.

Since the increase of the resistance against the operation of the operating cable can be avoided, the lightness of the shifting operation can be improved. Since the transmission mechanism is adaptable to spaces respectively having various different shapes, choices of disposing the transmission mechanism can be increased.

According to the present invention, a guide means may be formed in the engine unit to guide the linking member for sliding substantially parallel to the operating cable.

Since the guide means guides the linking member for sliding along the direction of action of the operating force applied to the operating cable, frictional resistance exerted by the guide means on the linking member is low, load on the operation of the operating cable is small and hence the lightness of the shifting operation is improved.

The guide means may be formed in a bracket fixed to the engine unit.

According to the present invention, the input member may be an input arm having a pivotal shaft having a fixed rotational axis and supported by support members on the engine unit.

Thus, the position of the joint of the input arm capable of turning about a fixed rotational axis and the linking member can be decided so as to conform to the position of the rotational axis regardless of the position of the joint of the operating cable and the linking member.

Since the position of the joint of the input arm and the linking member can be decided so as to conform to the position of the rotational axis of the input arm, the joint of the input arm and the linking member can be located at an optimum position from the viewpoint of the length of the input arm and the load on the longitudinal operation of the operating cable.

In an aspect of the present invention, there is provided a forward/backward gear shifting mechanism for an outboard engine including: an operating cable for transmitting operating force applied to an operating member disposed outside an engine unit included in the outboard engine; a shift rod for shifting a forward/backward gear included in a propulsion unit; a driving member operatively connected to the shift rod to drive the shift rod; and a transmission mechanism connected to the operating cable to transmit the operating force to the driving member; wherein the transmission mechanism includes an arm mechanism pivotally supported on support members included in the engine unit and capable of turning about a fixed rotation axis.

Since the arm mechanism turns about the fixed rotational axis, looseness of a transmission passage through which the operating force transmitted by the operating cable is transmitted to the driving member for driving the shift rod can be eliminated or can be reduced to the least possible extent. Consequently, the transmission mechanism operates without time lag between the motions of turning members included therein. Since the arm mechanism turns about the fixed rotational axis and is not translated, the transmission mechanism is able to move in a narrow range, and can be formed in compact construction and installed in a narrow space.

Preferably, the arm mechanism includes an input arm and an output arm connected to the input arm for turning together with the input arm, the input arm is linked to the operating cable, and the output arm is linked to the driving member.

Thus, the input and the output arm or portions of the input and the output arm can be placed at different vertical positions, respectively, or the positional relation between the input and the output arm with respect to a direction along a circle having its center on the rotational axis can be easily changed. Therefore, the transmission mechanism is adaptable to spaces respectively having various different shapes and there are many choices of disposing the transmission mechanism.

The input arm and the operating cable may be linked within the engine unit by a linking structure having a slot that enables the operating cable to move along a substantially straight line in a moving range corresponding to a turning range in which the input arm turns.

Since the operating cable is able to move along a substantially straight line in the moving range corresponding to the turning range in which the input arm turns, the operating cable will not bend when the same is pulled or pushed by the operating force, the increase of the resistance against the operation of the operating cable can be avoided and hence the lightness of the shifting operation can be improved.

In a further aspect of the present invention, there is provided a forward/backward gear shifting mechanism for an outboard engine including: a shift rod for shifting a forward/backward gear included in a propulsion unit; a neutral-indicating switch having an actuator capable of being moved in moving directions to detect the shift of the forward/backward gear to a neutral position; and a swinging operating arm having a pressing part for pressing the actuator; wherein the operating arm turns about a rotation axis extended such that a displacement of the pressing part in the moving directions of the actuator in a moving range in which the actuator moves is greater than a displacement of the same in a direction perpendicular to the moving directions in which the actuator moves as viewed in the direction in which the rotation axis is extended.

Since the displacement of the pressing part in the moving directions in which the actuator moves is greater than the displacement of the same in the direction perpendicular to the moving directions in which the actuator moves, the angular movement of the operating arm to operate the neutral-indicating switch is less than that in the conventional technique and the position of the rotational axis of the operating arm is independent of the moving directions of the actuator. Consequently, there are many choices of disposing the neutral-indicating switch, the forward/backward gear shifting mechanism can be formed in compact construction, and the neutral-indicating switch can be disposed in a narrow space in the engine unit.

In a still further aspect of the present invention, there is provided a forward/backward gear shifting mechanism for an outboard engine including: a shift rod to be driven by operating force to shift a forward/backward gear included in a propulsion unit; a neutral-indicating switch having an actuator and capable of detecting the shift of the forward/backward gear to a neutral position; and an operating member having a pressing part for moving the actuator in opposite directions; wherein a cam operates the operating member in synchronism with the operation of the shift rod, a spring urges the operating member toward the cam, and a projection formed on one of the operating member and the cam engages in a depression formed on the other of the operating member and the cam when the forward/backward gear is shifted to a neutral position.

Since the spring for creating a click needs to be disposed simply so as to urge the operating member toward the cam, there are many choices of disposing the neutral-indicating switch. Since the click is created by the engagement of the projection formed on the operating member of the cam in the depression formed in the cam or the operating member, the operating member functions both to operate the neutral-indicating switch and to create a click. Thus, there are many choices of disposing the neutral-indicating switch, the forward/backward gear shifting mechanism can be formed in compact construction, and the neutral-indicating switch can be disposed in a narrow space in the engine unit. Thus, time lag between the time when the shift of the forward/backward gear to the neutral position is detected by the neutral-indicating switch and operator's perception of a click can be prevented.

The operating member may be a swingable operating arm, and the spring may be put on a boss formed on the operating arm.

The spring is wound about the rotational axis so as to surround the boss of the operating arm compactly and hence the forward/backward gear shifting mechanism can be formed in compact construction.

In a further aspect to the present invention, there is provided a forward/backward gear shifting mechanism for an outboard engine capable of being tilted about a tilting axis and of being turned about a steering axis including: an operating cable for transmitting operating force applied to an operating member disposed outside an engine unit included in the outboard engine; a shift rod for shifting a forward/backward gear included in a propulsion unit; a driving member connected to the shift rod for turning together with the shift rod to drive the shift rod; and a transmission mechanism linked to the operating cable to transmit the operating force to the driving member; wherein the transmission mechanism includes an input member linked to the operating cable, and an output arm linked to the driving member, the output arm is pivotally supported on support members on the engine unit for turning about a fixed rotational axis, the rotational axis is located nearer to a connecting member connecting the operating cable and the input member than to a reference plane including the steering axis and perpendicular to the tilting axis.

Since the rotation axis of the output arm is nearer to the connecting member connecting the operating cable and the input member than to the reference plane, the distance between the rotational axis and the connecting member connecting the operating cable and the input member is shorter than the distance between the reference plane and the connecting member. Therefore, the distance between the rotational axis and the connecting member is shorter than the corresponding distance in the prior art transmission mechanism, and the transmission mechanism has compact construction and can be installed in a narrow space.

In this forward/backward gear shifting mechanism, the angle in a plane between a first half line extending from the rotational axis toward the axis of the shift rod and a second half line extending from the rotational axis toward a center axis of the connecting member is an inferior angle greater than 90°, or 180°, and the operating cable is extended from a position in front of the engine unit through an outer pipe fixed to a stationary member attached to the engine unit above the tilting axis and on the front side of the connecting member into the engine unit.

Since the longitudinal distance between the rotational axis of the output arm and the shift rod is short, and the rotational axis is longitudinally nearer to the shift rod than to the corresponding rotational axis of the prior art forward/backward gear shifting mechanism, a necessary longitudinal stroke of the operating cable can be secured between the joint and the stationary part without shifting the stationary member forward and the operating cable will not be excessively bent in front of the engine unit even if the engine unit is tilted at a large angle, and hence the increase of resistance against the operation of the operating cable due to the bend of the operating cable can be avoided and the lightness of the shifting operation can be improved.

In this forward/backward gear shifting mechanism, the input member may be an input arm connected to the output arm for turning together with the output arm, and the transmission mechanism may be an arm mechanism including the input arm and the output arm.

Since the input arm and the output arm forming the arm mechanism turn together about the rotational axis, looseness of a transmission passage through which the operating force transmitted by the operating cable is transmitted to the driving member for driving the shift rod can be eliminated. Consequently, the transmission mechanism operates without time lag between the motions of the component members thereof. Since the arm mechanism is pivotally supported on the stationary support members and is not translated, the transmission mechanism moves in a narrow range. Since the input and the output arms can be disposed at different vertical positions, respectively, and the circumferential arrangement of the input and the output arms on a circle having its center on the rotational axis can be easily changed, the transmission mechanism is adaptable to spaces respectively having various different shapes.

Consequently, the time lag between the motions of the component parts of the transmission mechanism can be prevented and thereby the shift feel is improved. Since the transmission mechanism moves in a narrow range, the transmission mechanism is compact and can be installed in a narrow space. Since the transmission mechanism is adaptable to spaces respectively having various different shapes, there are many choices of disposing the transmission mechanism.

DESCRIPTION OF THE PREFERRED EMBODIMENTS

A forward/backward gear shifting mechanism in a preferred embodiment of the present invention will be described with reference to FIGS. 1 to 7, in which terms qualifying directions and sides, such as right, left, front, rear, longitudinal and lateral, are used to qualify directions and sides with respect to the advancing direction of a ship provided with an outboard engine including the forward/backward gear shifting mechanism of the present invention.

Figure 1:
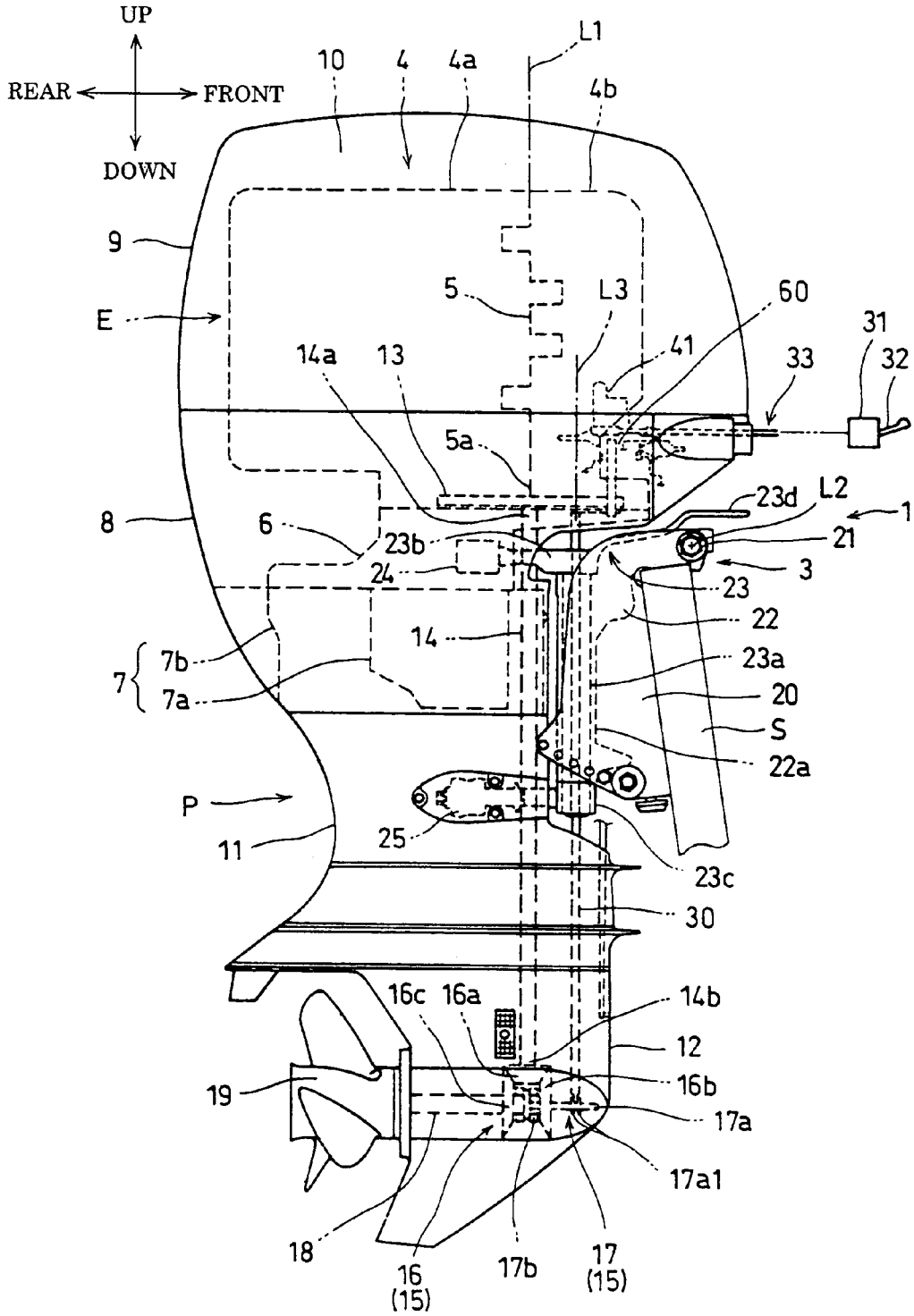
FIG. 1 is a side elevation of an outboard engine provided with a forward/backward gear shifting mechanism in a preferred embodiment of the present invention taken from the right side of the outboard engine.

Referring to FIG. 1, an outboard engine 1 has an engine unit 2 including an internal combustion engine E, and a propulsion unit P having a propeller 19 driven by the internal combustion engine E to produce a thrust, and a supporting device 3 supporting the engine unit 2 on a ship S.

The internal combustion engine E is an inline four-cylinder four-stoke-cycle overhead camshaft (OHC) internal combustion engine. The internal combustion engine E has an engine body 4 including a cylinder block 4*a* and a crankcase 4*b* joined to the front end of the cylinder block 4*a*. A crankshaft 5 is supported for rotation between the cylinder block 4*a* and the crankcase 4*b* with its rotational axis L1 vertically extended.

The following description will be made based on a standard condition in which the engine unit 2 of the outboard engine 1 shown in FIG. 1 is turned in a horizontal plane about a vertical steering axis L3 of the engine unit 2.

The engine body 4 is joined to the upper end of a mount case 6. An oil case 7 having an oil pan 7*a* and a side wall 7*b* is joined to the lower end of the mount case 6. A lower part of the engine body 4, the mount case 6 and the oil case 7 are covered with a cylindrical undercover 8. The undercover 8 is joined to the oil case 7 or an extension case 11. An engine cover 9 covering an upper part of the engine body 4 is joined to the upper end of the under cover 8. The engine cover 9, and the undercover 8 attached to a flange surrounding the mount case 6 define an engine room 10 containing the engine body 4 and extending over the mount case 6. The extension case 11 is joined to the lower end of the oil case 7, and a gear case 12 is joined to the lower end of the extension case 11. The bottom wall of the mount case 6, the side wall 7*b* of the oil case 7 and the extension case 11 define an exhaust chamber communicating with an exhaust passage formed in the gear case 12.

A flywheel 13 is fixedly mounted on a lower part of the crankshaft 5. The upper end 14*a* of a drive shaft 14 is fixedly connected to the lower end 5*a* of the crankshaft 5. The drive shaft 14 coaxial with the crankshaft 5 extends vertically downward from the lower end 5*a* of the crankshaft 5 through the mount case 6 and the extension case 11 into the gear case 12. The drive shaft 14 is interlocked with a propeller shaft 18 in the gear case 12 by a forward/backward gear 15 consisting of a gear mechanism 16 and a clutch mechanism 17.

The power of the internal combustion engine E is transmitted from the crankshaft 5 through the drive shaft 14, the forward/backward gear 16 and the propeller shaft 18 to a propeller 19 to rotate the propeller 19.

The drive shaft 14, the forward/backward gear 15, the propeller shaft 18, the propeller 19, the under cover 8, the extension case 11 and the gear case 12 are the components of the propulsion unit P. The internal combustion engine E, the propulsion unit P and the engine cover 9 form the engine unit 2. The undercover 8 and the engine cover 9 are walls defining the engine room 10, and form an upper cover covering an upper part of the engine unit 2 in a space above the level of the tilt shaft 21.

The support device 3 has paired right and left stern brackets 20 detachably attached to the ship S, a swivel case 22 supported for turning in a vertical plane on the right and the left stern bracket 20 by the tilt shaft 21, and a mount frame 23 supporting the engine unit 2 and supported for turning in a horizontal plane by a bearing part 22*a* of the swivel case 22.

The mount frame 23 has a swivel shaft 23*a* rotatably fitted in a bore formed in the bearing part 22*a*, paired right and left upper mounting parts 23*b* attached to the upper end of the swivel shaft 23*a*, a lower mounting part 23*c* detachably attached to the lower end of the swivel shaft 23*a*, and a steering arm 23*d* connected to the upper end of the swivel shaft 23*a* so as to extend forward.

The engine unit 2 is supported on the mount frame 23 by placing an upper mount rubber 24 between the mount case 6 and an upper mounting part 23*b*, fastening the mount case 6 to the upper mounting part 23*b* with bolts, placing paired right and left lower mount rubbers 25 between the extension case 11 and a lower mounting part 23*c*, and fastening the extension case 11 to the lower mounting part 23*c* with bolts.

The engine unit 2 is turned about the tilting axis L2 (FIG. 2) aligned with the axis of the swivel case 22 in a vertical plane for tilting by a hydraulic mechanism, not shown, including a hydraulic cylinder actuator. The engine unit 2 is turned about the steering axis L3 aligned with the axis of the swivel shaft 23*a* in a horizontal plane for steering by operating a steering handle, not shown, connected to a steering arm 23*d* or by remotely operating the steering arm 23*d*.

The gear mechanism 16 includes a drive gear 16*a* fixedly mounted on the lower end 14*b* of the drive shaft 14, a forward gear 16*b* and a backward gear 16*c*. The forward gear 16*b* and the backward gear 16*c* are mounted on a front part of the propeller shaft 18 for free rotation relative to the propeller shaft 18 and are constantly meshed with the drive gear 16*a*.

The clutch mechanism 17 includes a shifter 17*a* axially moved on the propeller shaft 18 by operating a shift rod 30, and a clutch element 17*b* fixedly connected to the shifter 17*a*. Flanges 17*a*1 are formed on the shifter 17*a* so as to form an annular space for receiving the lower end of the shift rod 30. The shift rod 30 is turned to shift the shifter 17*a* axially on the propeller shaft 18. The clutch element 17*b* is provided with internal splines, and the propeller shaft 18 is provided with external splines engaged with the internal splines of the clutch element 17*b*. Thus, the clutch element 17*b* rotates together with the propeller shaft 18 and is able to slide axially on the propeller shaft 18. The clutch element 17*b* is engaged selectively with either the forward gear 16*b* or the backward gear 16*c*.

When the clutch mechanism 17 of the forward/backward gear 15 is set for a neutral position by operating the shift rod 30, the clutch element 17*b* is in engagement with neither of the forward gear 16*b* and the backward gear 16*c*, the forward gear 16*b* and the backward gear 16*c* rotate on the propeller shaft 18, and the rotation of the drive shaft 14 is not transmitted to the propeller shaft 18. When the clutch mechanism 17 is set for a forward-drive position, the clutch element 17*b* is engaged with the forward gear 16*b*. Consequently, the rotation of the drive shaft 14 is transmitted through the forward gear 16*b* and the clutch element 17*b* to the propeller shaft 18 to drive the propeller shaft 18 for rotation in the normal direction and thereby the ship S is propelled forward. When the clutch mechanism 17 is set for a backward-drive position, the clutch element 17*b* is engaged with the backward gear 16*c*. Consequently, the rotation of the drive shaft 14 is transmitted through the backward gear 16*b* and the clutch element 17*b* to the propeller shaft 18 to drive the propeller shaft 18 for rotation in the reverse direction and thereby the ship S is propelled backward. Thus, the clutch mechanism 17 is operated by the shift rod 30 to set the forward/backward gear 15 selectively in a neutral position, a forward-drive position or a backward-drive position.

Figure 2:
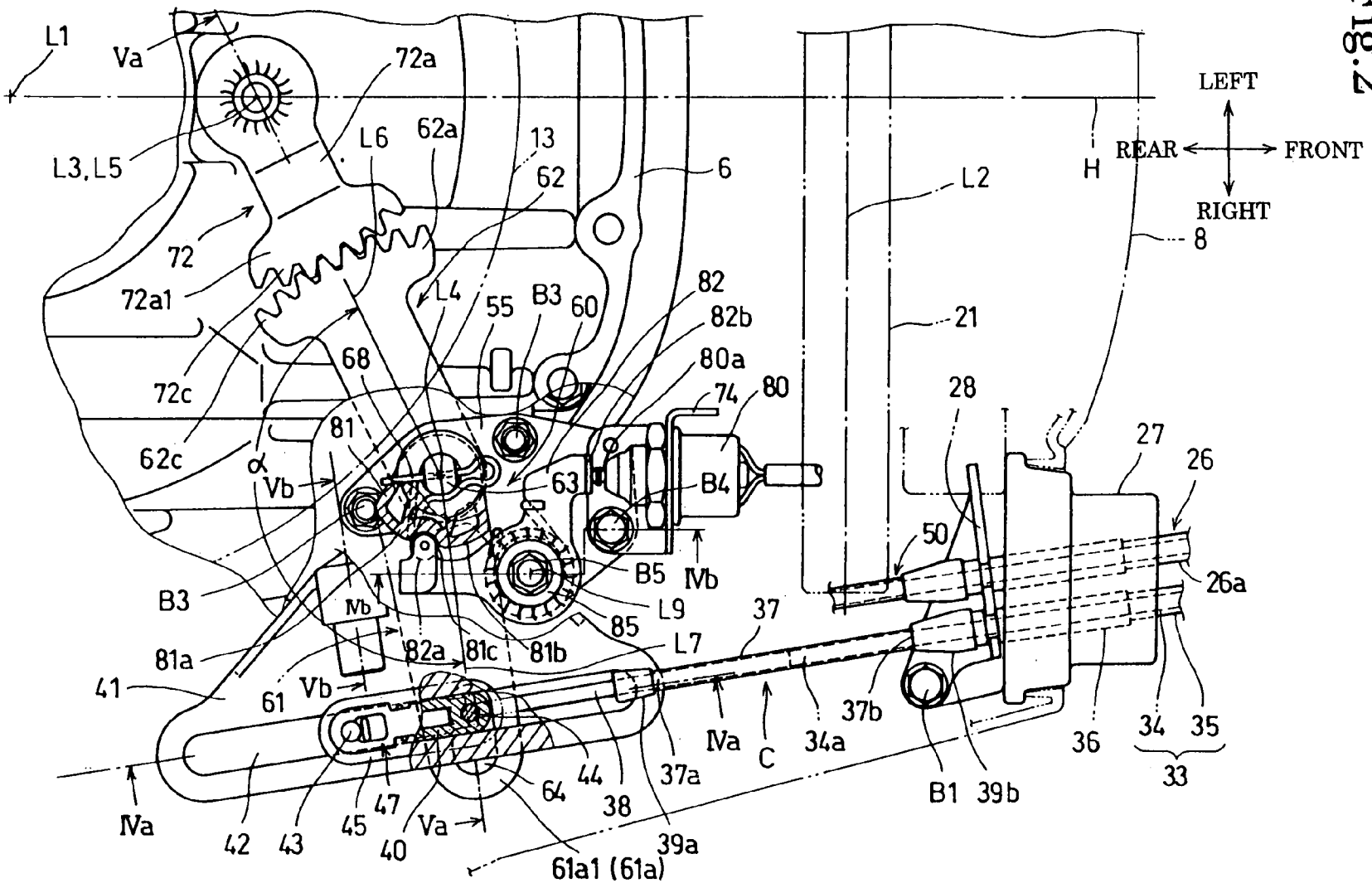
FIG. 2 is a partly sectional plan view of an essential part of the forward/backward gear shifting mechanism installed in an engine room formed in the outboard engine shown in FIG. 1.

Referring to FIGS. 1 and 2, a shifting system having an operating cable C is remotely operated to operate the clutch mechanism 17. The shifting system includes a remote controller 31 to be operated by an operator to shift the forward/backward gear 15, an operating handle 32 for operating the remote controller 31, a Bowden cable 33 for transmitting operating force applied to the operating handle 32, and a transmission mechanism 60 installed in the engine room 10 of the engine unit 2 and capable of transmitting the operating force transmitted thereto by the operating cable C to a drive arm 72, i.e., a driving member. The shifting system further includes the shift rod 30 extended in front of the drive shaft 14 in a vertical position, the drive arm 72, i.e., a sector gear, fixedly mounted on the shift rod 30 for turning together with the shift rod 30, driven by the operating force transmitted thereto by the transmission mechanism 60 to turn the shift rod 30, a neutral-indicating switch 80 for indicating the shift of the forward/backward gear 15 to a neutral position, and a switch operating mechanism for operating the neutral-indicating switch 80.

The shift rod 30 is passed through the tubular swivel shaft 23*a* substantially coaxially with the latter and extends downward through the extension case 11 into the gear case 12. The lower end of the shift rod 30 is engaged in the annular groove between the flanges 17*a*1 of the shifter 17*a* in the gear case 12.

The remote controller 31 is disposed in a pilothouse apart from the outboard engine 1. The steering handle 32, i.e., a steering member, is used for operating a throttle valve to control the flow rate of air taken by the internal combustion engine E as well as shifting the forward/backward gear 16.

The Bowden cable 33 has a flexible inner cable 34 for transmitting operating force applied to the operating handle 32, and a flexible case 35 enclosing the inner cable 34.

The case 35 has an outer end extending outside the engine unit 2 and attached to the remote controller 31, and an inner end passed through a grommet 27 attached to the right surface of the under cover 8. Another Bowden cable 26 for operating the throttle valve has a case 26*a* passed through the grommet 27. A holding tube 36 is put on the inner end of the case 35 to hold the case 35 fixedly on a bracket 28 fastened to the undercover 8 with bolts B1 in the engine room 10. The holding tube 36 is attached to the bracket 28 to hold the case 35 on the under cover 8. The bracket 28 serves as a holding member included in the engine unit 2 and holding the case 35.

The bracket 28 is disposed on the right-hand side of a reference plane H including the steering axis L3 and perpendicular to the tilting axis L2. The operating cable C extends from a position in front of the engine unit 2 through a right-hand part of the under cover 8 into the engine room 10. The bracket 28 is disposed above and in front of the tilting shaft 21.

The inner cable 34 extending backward from the bracket 28 in the engine room 10 is inserted in a metal guide pipe 37 to prevent the inner cable 34 from bending. An end part 34*a*, extending in the guide pipe 37, of the inner cable 34 is slidable in the guide pipe 37. A connecting rod 38 extending rearward beyond the rear end 37*a* of the guide pipe 37 is connected to the rear end of the end part 34*a* of the inner cable 34. Flexible, tubular sealing members 39*a* and 39*b* formed of an elastic material, such as rubber, are put on the rear end 37*a* and the front end 37*b* of the guide tube 37 so as to cover the front end of the connecting rod 38 and the rear end of the holding tube 36, respectively. The guide pipe 37 is connected to the holding tube 36 by a universal coupling in the sealing member 39*b*.

Referring to FIGS. 2 to 5, a slider 40 is fitted in a guide slot 42 formed in a bracket 41 so as to slide along the guide slot 42. The bracket 41 has a pair of bosses 41*a* (FIGS. 3 and 5) fastened to the crankcase 4*b* with bolts B2. The operating cable C is connected to the slider 40 with a first pin 43, and an input arm 61 included in the transmission mechanism 60 is connected to the slider 40 with a second pin 44. The pins 43 and 44 are firmly fitted in through holes formed in the slider 40. The slider 40 has a flange 40*a* in contact with the lower surface of the bracket 41, and a slider body 40*b* fitted in the guide slot 42. A holding plate 45 is put on the pins 43 and 44, and snap rings 46 are fitted in annular grooves formed in the pins 43 and 44 to hold the slider 40 on the bracket 41 so as to slide along the guide slot 42.

Figure 3:
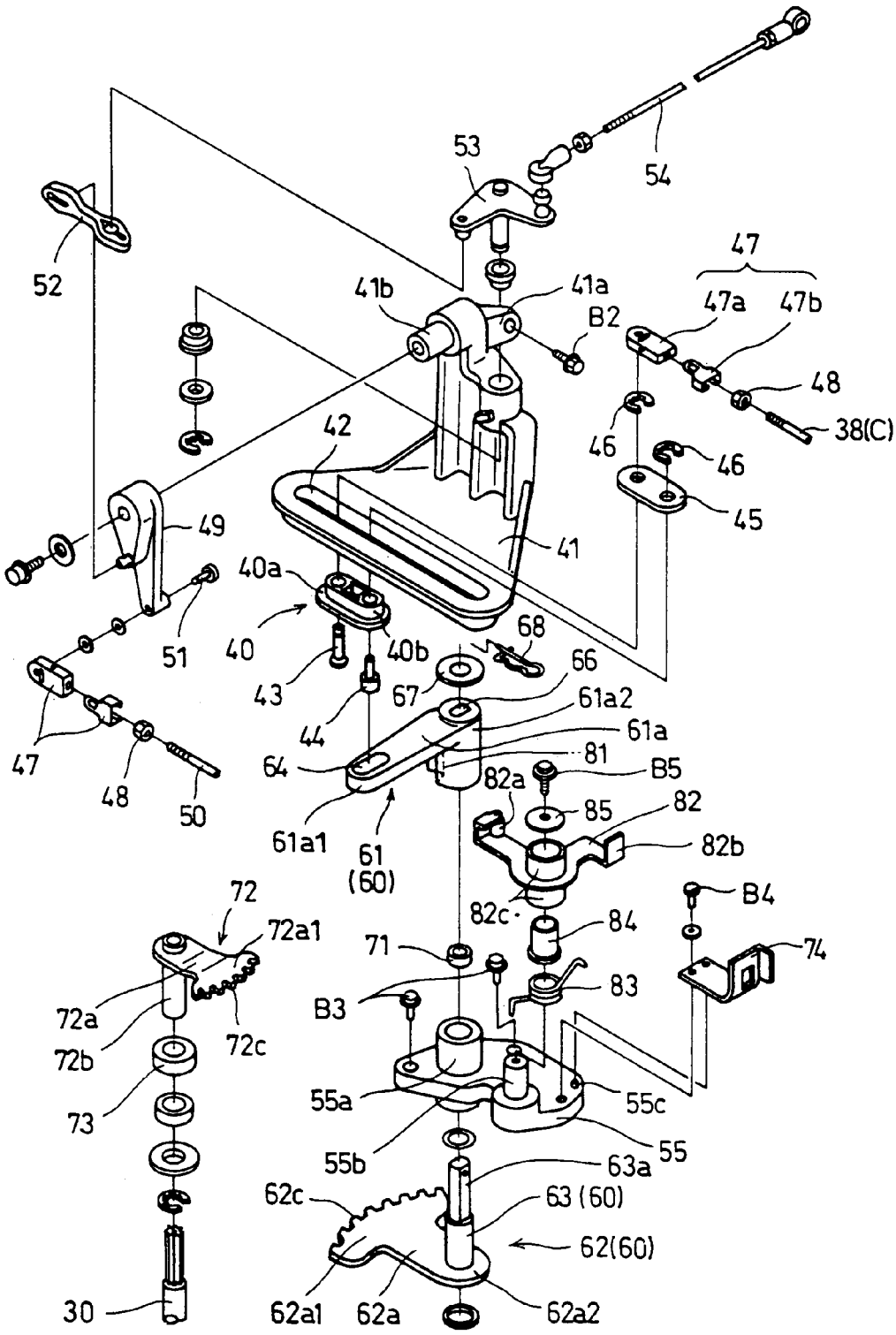
FIG. 3 is an exploded perspective view of the forward/backward gear shifting mechanism shown in FIG. 2.

As best shown in FIG. 3, a connector 47 is put on the free end of the first pin 43. The connecting rod 38 is screwed in a threaded hole formed in the connector 47 and a locknut 48 put on the externally threaded part of the connecting rod 38 is screwed down firmly against the end of the connector 47 to connect the connector 47 securely to the connecting rod 38. The connector 47 has a first member 47*a* that engages with the first pin 43 when the inner cable 34 is pushed, and a second member 47*b* that engages with the first pin 43 when the inner cable 34 is pulled.

The inner cable 34 pushed or pulled by the operating force applied to the operating handle 32 causes the slider 40 to slide in a sliding range in the guide slot 42 substantially parallel to the operating cable C. The sliding range is equal to the stroke of the operating cable C corresponding to an angular range of turning of the input arm 61 for shifting operation. The length of the guide pipe 37 is determined on the basis of the stroke of the operating cable C such that the end of the inner cable 34 does not extend outside from the guide pipe 37. The minimum distance between the first pin 43 and the bracket 28 is dependent substantially on the length of the guide pipe 37 and the stroke of the operating cable C.

The inner cable 34 is passed through the undercover 8, and is linked to the input arm 62 in the engine room 10 by the connecting rod 38 and the slider 40. The inner cable 34 may be connected directly to the slider 40. The operating cable C is functionally equivalent to the inner cable 34, and an operative means formed by connecting the connecting rod 38 to the inner cable 34.

The second pin 44 in front of the first pin 43 is nearer to the bracket 28 than the first pin 43. The lower end of the second pin 44 is slidably fitted in a slot 64 formed in the input arm 61 disposed under and close to the bracket 41.

Referring to FIG. 3, the bracket 41 has a boss 41*b* for pivotally supporting a throttle arm 49. A throttle operating cable 50 for operating a throttle valve is connected to the throttle arm 49. The throttle operating cable 50 is similar in construction to the operating cable C. A pin 51 is put on the free end of the throttle arm 49. A connector 47 is put on the free end of the pin 51. A connecting rod 38 is screwed in a threaded hole formed in the connector 47 and a locknut 48 put on the externally threaded part of the connecting rod 38 is screwed down firmly against the end of the connector 47 to connect the connector 47 securely to the connecting rod 38. A bell crank 53 pivotally supported on the bracket 41 has a first arm connected to the throttle arm 49 by a link 52, and a second arm connected to a connecting rod 54 connected to an arm connected to the valve shaft of the throttle valve.

The transmission mechanism 60 (FIG. 1) disposed in the engine room 10 includes the input arm 61, i.e., an input member, linked to the operating cable C, an output arm 62, i.e., an output member, linked to a drive arm 72. The input arm 61 and the output arm 62 are combined for simultaneous turning.

Figure 5:
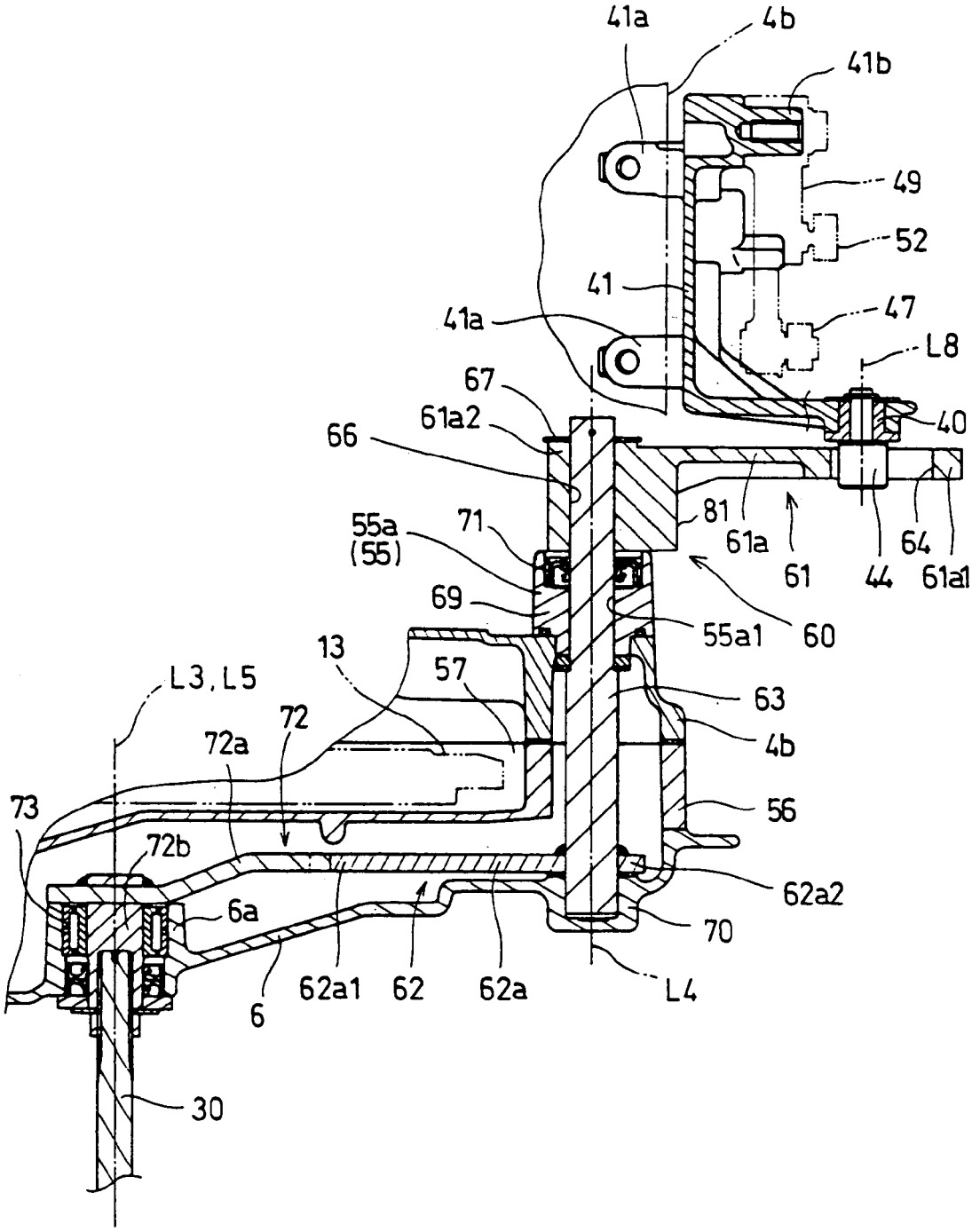
FIG. 5 is sectional views taken on the line Va—Va and on the line Vb—Vb in FIG. 2.

Referring to FIGS. 3 and 5, a holder 55 is fastened to the crankcase 4*b* with bolts B3. The input arm 61 is supported on the holder 55. The input arm 61 has an arm part 61*a* linked to the operating cable C by the slider 40, and a pivotal shaft 63 that turns together with the arm part 61*a*. A linking structure including a slot 64 formed in the arm part 61*a* links the input arm 61 and the slider 40 together to enable the operating cable C to move along a substantially straight line between the bracket 28 and the first pin 43 in the engine room 10 to turn the input arm 61 in its turning range. The linking structure consists of a free end part 61*a*1 of the arm part 61*a* provided with the slot 64 perpendicular to a rotation axis L4, and the second pin 44 attached to the slider 40 that slides in the slot 64.

The arm part 61*a* has a base end 61*a*2 seated on the upper end of a boss 55*a* formed in the holder 55. The base end 61*a*2 is provided with a through hole 66 having a shape complementary to the shape of a flat part 63*a* (FIG. 3) having opposite flat surfaces of the pivotal shaft 63. The pivotal shaft 63 is inserted in the through hole 66, a washer 67 is put on a part of the pivotal shaft 63 projecting from the through hole 66, and a retaining pin 68 is inserted in a hole formed in an end part of the pivotal shaft 63 to retain the arm part 61*a* on the pivotal shaft 63. A cam 81 is formed integrally with the base part 61*a*2.

The output arm 62 has the shape of a sector gear. The output arm 62 has an arm part 62*a* having an edge part 62*a*1 provided with teeth 62*c* meshed with the teeth 72*c* of the drive arm 72, and the pivotal shaft 63 welded to the arm part 62*a*. As shown in FIG. 5, the pivotal shaft 63 is pivotally supported by a fixed support member 69 held on the holder 55, and having a boss 55*a* provided with a through hole 55*a*1 receiving a middle part of the pivotal shaft 63, and a fixed support member 70 placed on the mount case 6 and provided with a recess rotatably receiving a lower end part of the pivotal shaft 63.

The drive arm 72 and the arm part 62*a* lying below the holder 55 are contained in a space defined by the mount case 6 and the pump body 56 of an oil pump. The lower end part of the pivotal shaft 63 welded to the base part 62*a*2 of the arm part 62*a* is supported in the support member 70. The pivotal shaft 63 extends upward outside a flywheel chamber 57 defined by the pump body 56, the crankcase 4*b* and the cylinder block 4*a*, and containing the flywheel 13. The gap between the pivotal shaft 63 and the boss 55*a* is sealed by an oil seal 71. An upper end part of the pivotal shaft 63 is joined to the input arm 61.

The input arm 61 and the output arm 62 supported by the support members 69 and 70 for turning about the rotational axis L4 aligned with the center axis of the pivotal shaft 63. The input arm 61 and the output arm 62 thus held on the pivotal shaft 63 supported by the support members 69 and 70 turn together about the rotational axis L4. The arm part 61*a* of the input arm 61 is joined to the upper end part of the pivotal shaft 63, and the arm part 62*a* of the output arm 62 is joined to the lower end part of the pivotal shaft 63.

Referring to FIG. 2, the rotational axis L4 is separated radially from the flywheel 13, and extends on the front side of the center axis L5 of the shift rod 30 aligned with the steering axis L3 and on the side of the first pin 43 with respect to the reference plane H. The position of the rotational axis L4 in a plane is determined such that the angle α between a first half line L6 extending from the rotational axis L4 toward the center axis L5 of the shift rod 30, and a second half line L7 extending from the rotational axis L4 toward the center axis L8 (FIG. 8) of the second pin 44 connected to the input arm 61 is an inferior angle greater than 90°, or 180°.

The angle α is determined according to the position of the pivotal shaft 63 such that the second half line L7 intersects the operating cable C substantially perpendicularly in a plane when the input arm 61 is located at a position corresponding to the neutral position of the forward/backward gear 15. Thus, a force necessary to push the operating cable C and a force necessary to pull the operating cable C are approximately equal.

Referring to FIGS. 3 and 5, the drive arm 72 has an arm part 72*a* having an edge part 72*a*1 provided with the teeth 72*c*, and a shaft 72*b* supported in a bearing 73 on a support part 6*a* of the mount case 6. A lower part of the shaft 72*b* and an upper end part of the shift rod 30 are interlocked by splines to turn the drive arm 72 by the shift rod 30.

Figure 4:
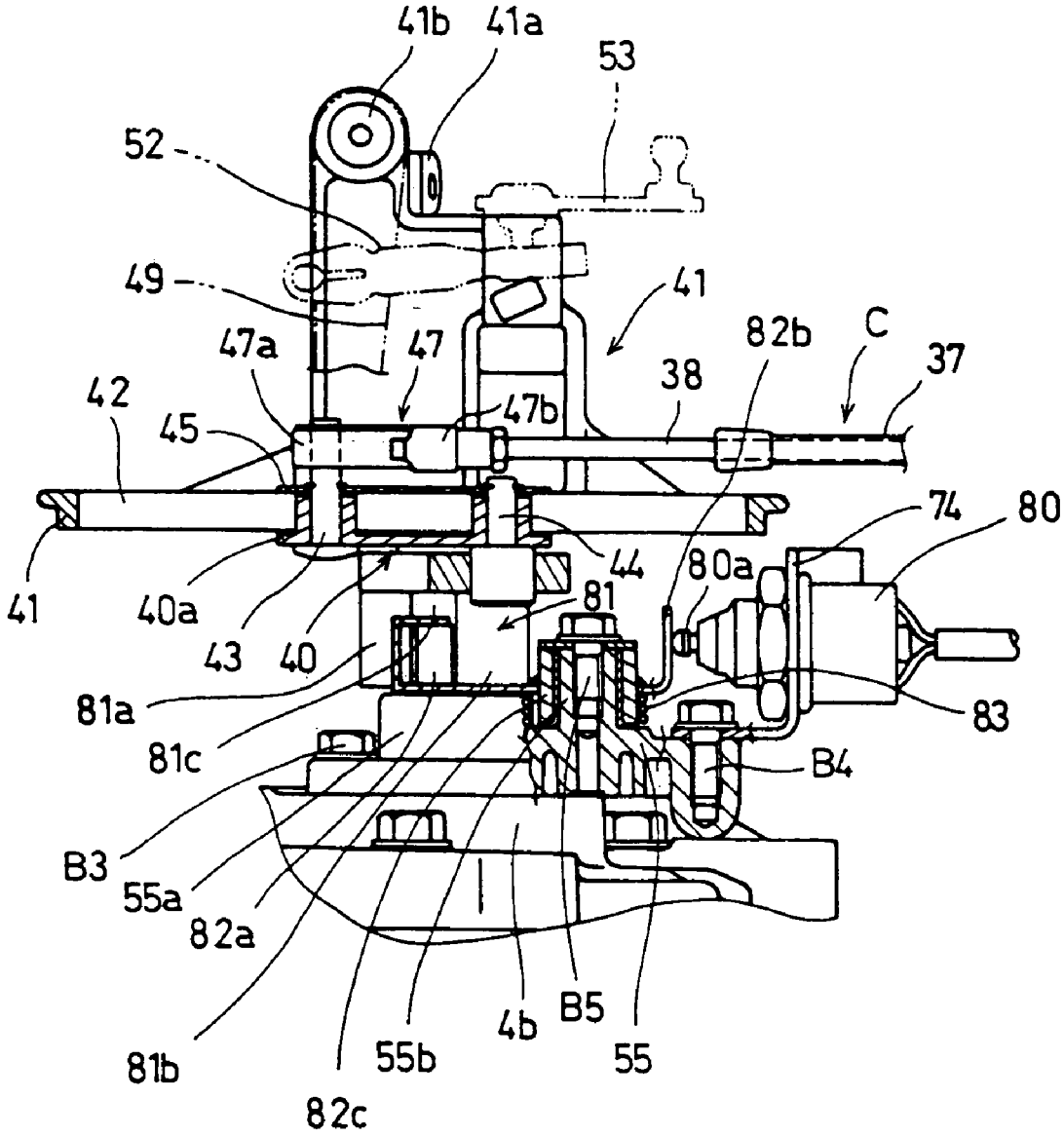
FIG. 4 is sectional views taken on the line IVa—IVa and the line IVb—IVb in FIG. 2.

Referring to FIGS. 2 and 4, the neutral-indicating switch 80 for indicating the shift of the forward/backward gear 15 to a neutral position, and the switch operating mechanism for operating the neutral-indicating switch 80 are attached to the holder 55 pivotally supporting the input arm 61.

The neutral-indicating switch 80 is a limit switch provided with a protruding actuator 80*a*. An operating arm 82 moves the actuator 80*a* axially to open and to close the neutral-indicating switch 80. The neutral-indicating switch 80 is attached to a stay 74. The stay 74 is positioned on the holder 55 by a positioning pin 55*c* attached to the holder 55 and is fastened to the holder 55 with bolts B4.

Figure 6:
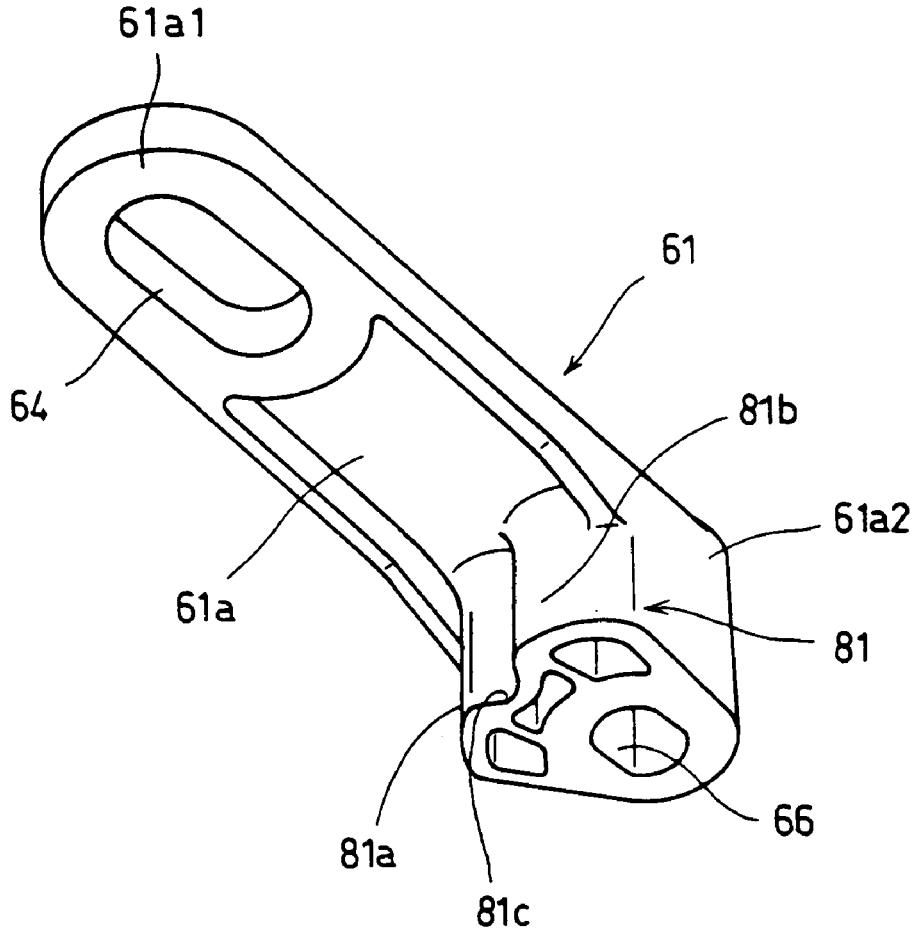
FIG. 6 is a perspective view of an input arm taken from below the input arm.

The switch operating mechanism includes the cam 81 formed on the input arm 61, the operating arm 82, i.e., an operating member, driven by the cam 81, and a spring 83 exerting resilient force on the operating arm 82 to keep the operating arm 82 in contact with the cam 81. As shown in FIG. 6, the cam 81 formed integrally with the input arm 61 turns about a rotational axis L4 (FIG. 2) in synchronism with the shift rod 30 to turn the operating arm 82 about a rotational axis L9. The cam 81 has a profile that makes the operator perceive a click to enable the operator recognize the shift of the forward/backward gear 15 to the neutral position. The cam 81 has a cam lobe 81*a* for opening the neutral-indicating switch 80 when the forward/backward gear 15 is shifted to the forward-drive position, a cam lobe 81*b* for opening the forward/backward gear 15 is shifted to the backward-drive position, and a depression 81*c* into which a roller 82*a* supported on the operating arm 82 drops.

The operating arm 82 has one end provided with a projection that produces a click in cooperation with the cam 81 and supporting the roller 82*a* serving as a cam follower in engagement with the cam 81, the other end provided with a pressing part 82*b* for pressing the actuator 80*a* of the neutral-indicating switch 80, and a middle part having a cylindrical boss 82*c* (FIG. 3). A bushing 84 is fitted in the boss 82*c* and shaft 55*b* formed on the holder 55 is fitted in the bushing 84. The operating arm 82 is put on the shaft 55*b* of the holder 55 and is held on the shaft 55*b* by fastening a washer 85 to the upper end of the boss 55*b* with a bolt B5.

Figure 7:
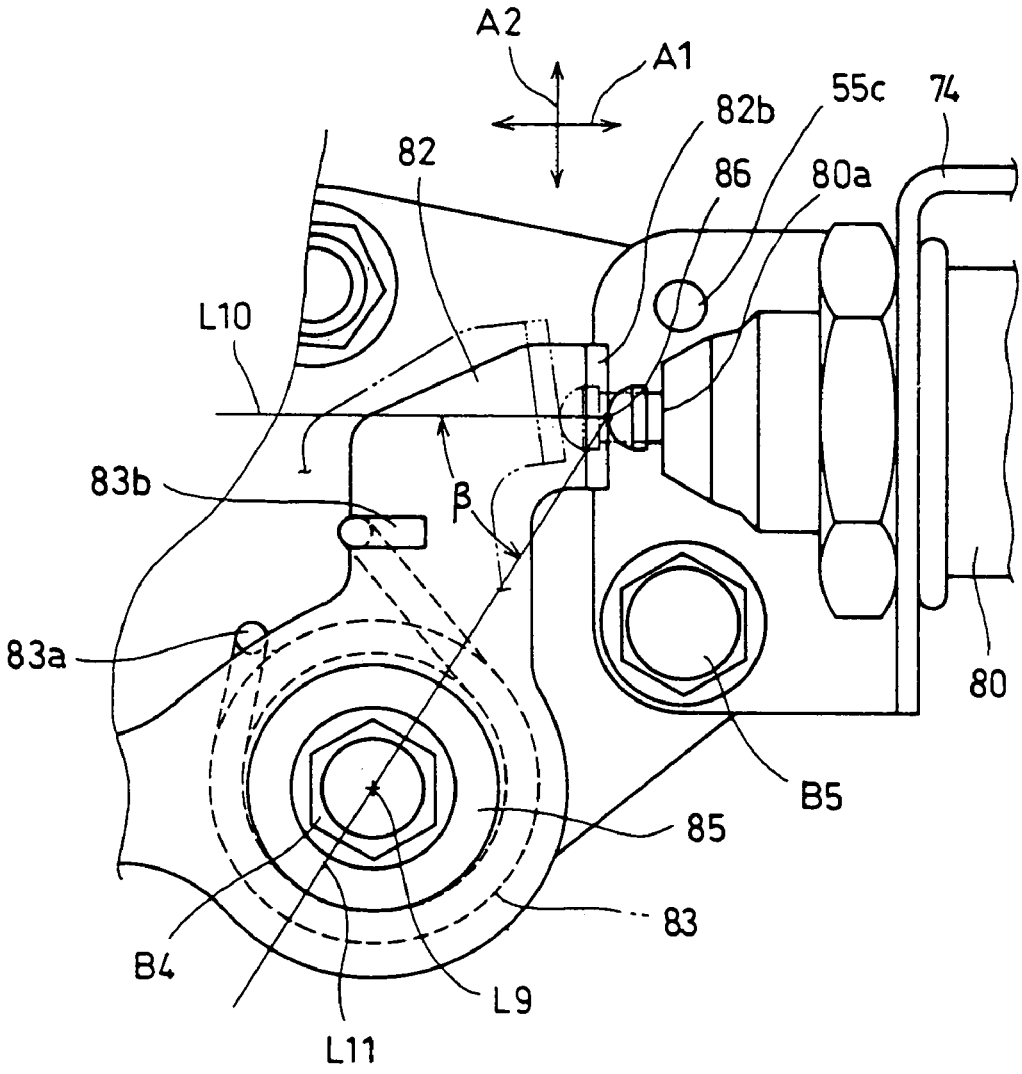
FIG. 7 is an enlarged view of a part of FIG. 2.

Referring to FIGS. 6 and 7, the spring 83 is wound round the boss 82*c* substantially coaxially with the rotational axis L9. The spring 83 has one leg 83*a* inserted in a hole formed in the holder 55, and the other leg 83*b* engaged with the operating arm 82. The spring 83 exerts a resilient force on the operating arm 82 so as to keep the roller 82*a* in contact with the cam 81.

Referring to FIG. 7, the rotational axis L9 about which the operating arm 82 turns is located such that the displacement of the pressing part 82*b* along directions A1 in which the actuator 80*a* moves is greater than the displacement of the same along directions A2 perpendicular to the directions A1. The respective positions of the neutral-indicating switch 80 and the rotational axis L9 are determined such that an angle β between a half line L10 extending parallel to the direction A1 from a contact point 86 where the actuator 80*a* and the pressing part 82*b* touch each other and a half line L11 extending from the contact point 86 and crossing the rotational axis L9 when the operating arm 82 is at a position corresponding to the neutral position of the forward/backward gear 15 is in the range of 45° to 135°.

The operation and effects of the forward/backward gear shifting mechanism embodying the present invention will be described.

Referring to FIG. 2 showing the forward/backward gear shifting mechanism in a state corresponding to the neutral position of the forward/reverse selector device 15, when the operator operates the operating handle 32 (FIG. 1) to shift the forward/backward gear 15 to the forward-drive position, the operating force applied to the operating handle 32 pulls the operating cable C (the inner cable 34) extended in the outer pipe 35 outside the engine unit 2. Consequently, the slider 40 is moved forward along the guide slot 42, and the input arm 61 connected to the slider 40 by the second pin 44 is turned counterclockwise to turn the output arm 62 counterclockwise. Then, the drive arm 72 engaged with the output arm 62 is turned clockwise to turn the shift rod 30 clockwise. Consequently, the shifter 17*a* (FIG. 1) is moved forward, the clutch element 17*b* is engaged with the forward gear 16*b* to shift the forward/backward gear 15 to the forward-drive position.

While the forward/backward gear 15 is being shifted from the neutral position to the forward-drive position, the cam 81 turns counterclockwise together with the input arm 61, the roller 82*a* supported on the operating arm 82 moves out of the depression 81*c* and engages with the cam lobe 81*a*. In this state, the operating arm 82 is turned counterclockwise about the rotational axis L9 against the resilience of the spring 83 to move the pressing part 82*b* away from the neutral-indicating switch 80. Consequently, the actuator 80*a* projects backward, as viewed in FIG. 2, as indicated by two-dot chain lines in FIG. 7 and the neutral-indicating switch 80 is opened.

When the operator operates the operating handle 32 to shift the forward/backward gear 15 from the forward-drive position to the neural position, the operating cable C is pushed to move the slider 40 backward. Consequently, the input arm 61 and the output arm 62 are turned clockwise, and the shifter 17*a* is moved backward to shift the forward/backward gear 15 to the neutral position.

During the shifting operation to shift the forward/backward gear 15 from the forward-drive position to the neutral position, the cam 81 is turned clockwise and the roller 82*a* moves from the cam lobe 81*a* toward the depression 81*c*. Upon the arrival of the cam 81 at a position corresponding to the neutral position of the forward/backward gear 15, the roller 82*a* drops into the depression 81*c*. Since the operating arm 82 is urged clockwise about the rotational axis L9 by the resilience of the spring 83, the operator is able to perceive a click upon the engagement of the roller 82*a* in the depression 81*c*. At the same time, the pressing part 82*b* pushes the actuator 80*a* to close the neutral-indicating switch 80.

When the operating handle 32 is operated to operate the forward/backward gear shifting mechanism in the state shown in FIG. 2 to shift the forward/backward gear 15 to the backward-drive position, the operating cable C is pushed by the operating force applied to the operating handle 32 to move the slider 40 backward along the guide slot 42 and to turn the input arm 61 and the output arm 62 clockwise. Consequently, the drive arm 72 and the shift rod 30 are turned counter-clockwise, the shifter 17*a* (FIG. 1) is moved backward to bring the clutch element 17*b* into engagement with the backward gear 16*c*. Thus, the forward/backward gear 15 is shifted to the backward-drive position.

During the shifting operation to shift the forward/backward gear 15 from the neutral position to the forward-drive position, the cam 81 is turned clockwise and the roller 82*a* moves out of the depression 81*c* and comes into engagement with the cam lobe 81*b*. The operating arm 82 is urged counterclockwise about the rotational axis L9 against the resilience of the spring 83, the pressing part 82*b* moves away from the neutral-indicating switch 80. Consequently, the actuator 80*a* projects backward, as viewed in FIG. 2, as indicated by two-dot chain lines in FIG. 7 and the neutral-indicating switch 80 is opened.

Similarly, the operator is able to perceive a click upon the engagement of the roller 82*a* in the depression 81*c* when the forward/backward gear 15 is shifted from the backward-drive position to the neutral position, and the neutral-indicating switch 80 is closed.

Since the transmission mechanism 60 is an assembly of the input arm 61, the output arm 62, and the shaft 63*a* fixedly interlocking the input arm 61 and the output arm 62, the transmission mechanism 60 transmits the operating force transmitted thereto through the operating cable C to the drive arm 72 to turn the shift rod 30 without lost motion. Thus, lost motion between the turning members of the transmission mechanism 60 can be prevented to improve the shift feel. Since the transmission mechanism 60 is compact, turns about the fixed rotational axis L4, does not translate and is able to operate in a narrow range, the transmission mechanism 60 can be installed in a narrow space.

Since the transmission mechanism 60 consists of only the input arm 61, the output arm 62, and the shaft 63*a* fixedly interlocking the input arm 61 and the output arm 62, the input arm 61 is connected to the operating cable C and the output arm 62 is engaged with the drive arm 72, the arm part 61 a of the input arm 61, and the arm part 62*a* of the output arm 62 can be disposed respectively at vertically different positions, and the relation between the respective angular positions of the arm parts 61*a* and 62*a* about the rotational axis L4 can be easily changed. Thus, the transmission mechanism 60 is adaptable to spaces having various different shapes and there are many choices of disposing the transmission mechanism 60.

Since the input arm 61 is interlocked with the operating cable C by the slider 40 that slides in the sliding range in the substantially straight guide slot 42 corresponding to the angular range of turning of the input arm 61 in the engine room 10, and operating cable C moves along a substantially straight line in the moving range corresponding to the angular range of turning of the input arm 61 without turning on the first pin 43, the operating cable C will not be bent when the same is pushed or pulled, and hence the increase of resistance against the operation of the operating cable C due to the bend of the operating cable C can be avoided and the lightness of the shifting operation can be improved.

The transmission mechanism 60 has the input arm 61 and the output arm 62, the output arm 62 is turnable about the fixed rotational axis L4, the rotational axis L4 is nearer to the first pin 43 than to the reference plane H, the distance between the rotational axis L4 and the first pin 43 is shorter than that between the reference plane H and the first pin 43, and hence the transmission mechanism 60 is compact. Thus, the transmission mechanism 60 can be installed in a narrow space and hence the engine unit 2 can be formed in compact construction.

The angle $\alpha$ in a plane between the first half line L6 and the second half line L7 is an inferior angle greater than 90°, or 180°, and the operating cable C is extended from the front side of the engine unit 2 through the outer pipe 35 fixed to the bracket 28 disposed above the tilting axis L2 and on the front side of the first pin 43 and through the undercover 8 into the engine unit 2. Thus, the longitudinal distance between the rotational axis L4 and the shift rod 30 is short, the rotational axis L4 is near the shift rod 30. Therefore, the necessary longitudinal stroke of the operating cable C can be secured between the first pin 43 and the bracket 28 without shifting the bracket 28 and the guide pipe 37 forward. Consequently, the outer pipe 35 and the inner cable 34 will not be excessively bent in front of the engine unit 2 even if the engine unit 2 is tilted at a large angle, and hence the increase of resistance against the operation of the operating cable C due to the bend of the operating cable C can be avoided and the lightness of the shifting operation can be improved.

The operating cable C is linked to the input arm 61 of the transmission mechanism 60 by the slider 40, the second pin 44 is nearer to the bracket 28 than the first pin 43, and hence the first pin 43 can be spaced a long distance apart from the bracket 28. Thus, the necessary longitudinal stroke of the operating cable C can be secured without shifting the bracket 28 forward. Consequently, the inner cable 34 will not be excessively bent in front of the engine unit 2 even if the engine unit 2 is tilted at a large angle, and hence the increase of resistance against the operation of the operating cable C due to the bend of the operating cable C can be avoided and the lightness of the shifting operation can be improved. The position of the second pin 44 is not uniquely dependent on the position of the first pin 43, the distance between the first pin 43 and the second pin 44 can be changed. Thus, the transmission mechanism 60 is flexibly adaptable to spaces of various different shapes and hence there are many choices of disposing the transmission mechanism 60.

The slider 40 slides substantially parallel to the operating cable C along the guide slot 42 of the bracket 41 fixed to the crankcase 4*b*, and moves in the direction of action of the operating force transmitted by the operating cable C. Therefore, only a low resistance is exerted by the bracket 41 on the slider 40, load on the operating cable C is small, and hence the lightness of the shifting operation is improved.

Since the input arm 61 has the pivotal shaft 63 having the fixed rotational axis L4 and the position of the second pin 44 on the input arm 61 having the fixed rotation axis L4 can be adjusted to the position of the rotational axis L4 regardless of the position of the first pin 43, the second pin 44 can be disposed at an optimum position, taking into consideration the length of the arm part of the input arm 61 and the load on the operating cable C.

Since the input arm 61 can be disposed such that the second half line L7 intersects the operating cable C perpendicularly or substantially perpendicularly in a plane when the input arm 61 is set at a position corresponding to the neutral position of the forward/backward gear 15, a force necessary to push the operating cable C and a force necessary to pull the operating cable C are approximately equal, which also improves the shift feel.

Since the rotational axis L9 about which the operating arm 82 turns is located such that the displacement of the pressing part 82*b* along the directions A1 in which the actuator 80*a* moves is greater than the displacement of the same along the directions A2 perpendicular to the directions A1, the angular displacement of the operating arm 82 necessary to operate the neutral-indicating switch 80 is small, the position of the rotational axis L9 of the operating arm 82 is not dependent on the directions A1 in which the actuator 80*a* moves, there are many choices of disposing the neutral-indicating switch 80, the forward/backward gear shifting mechanism can be formed in compact construction, and the neutral-indicating switch 80 can be placed in a narrow space in the engine room 10.

The switch operating mechanism includes the cam 81, the operating arm 82 that is turned by the cam 81 in synchronism with the turning of the shift rod 30, and the spring 83 exerting resilient force on the operating arm 82 to keep the operating arm 82 in contact with the cam 81, and the roller 82*a* supported on the operating arm 82 drops into the depression 81*c* of the cam 81 when the forward/backward gear 15 is shifted to the neutral position. Therefore, the spring 83 for creating a click needs to be disposed simply so as to urge the operating arm 82 toward the cam 81, and there are many choices of disposing the neutral-indicating switch 80. Thus, the forward/backward gear shifting mechanism can be formed in compact construction, and the neutral-indicating switch 80 can be disposed in a narrow space in the engine room 10. A click is produced by the engagement of the roller 82*a* supported on the operating arm 82 in the depression 81*c* of the cam 81. Since the operating arm 82 achieves both operating the neutral-indicating switch 80 and producing a click, time lag between the time when the shift of the forward/backward gear to the neutral position is indicated by the neutral-indicating switch and operator's perception of a click can be prevented.

Since the spring 83 is wound compactly around the cylindrical boss 82*c* having the rotational axis L9 of the operating arm 82, the forward/backward gear shifting mechanism can be formed in compact construction.

The operating arm 82 is turned in the same direction to shift the forward/backward gear 15 from the neutral position to the forward-drive position and to shift the same from the neutral position to the backward-drive position, the angular range of turning of the operating arm 82 is narrow as compared with that in which the operating arm needs to be turned in opposite directions to shift the forward/backward gear 15 from the neutral position to the forward-drive position and to shift the same from the neutral position to the backward-drive position, respectively. Thus, the forward/backward gear shifting mechanism can be formed in compact construction.

The following alterations are possible in the foregoing forward/backward gear shifting mechanism.

The transmission mechanism 60 may consist of a plurality of arm mechanisms, and the arm mechanisms may be interlocked by arms provided with meshed gear teeth. The input arm 61 and the output arm 62 may be supported for simultaneous turning on a shaft included in the engine unit 2.

Arms linked by a pin may be used instead of the output arm 62 and the drive arm 72, which are meshed sector gears. The shift rod 30 may be axially or vertically driven by a driving member engaged with the shift rod 30 to shift the forward/backward gear 15.

The operating arm 82 may be provided with a depression and the cam 81 may be provided with a projection capable of engaging in the depression of the operating arm 82 to produce a click instead of forming the projection on the operating arm 82 and forming the depression 81*c* in the cam 81.

The linking structure may include a slider provided with a slot, and a pin attached to the input arm and engaged in the slot.

Although there has been described what is the present embodiment of the invention, it will be understood by persons skilled in the art that variations and modifications may be made thereto without departing from the spirit or essence of the invention. The scope of the invention is indicated by the appended claims.

What is claimed is:

1. A forward/backward gear shifting mechanism for an outboard engine, comprising:

an operating cable passed through an outer pipe, the outer pipe fixed to a stationary member of an engine unit, where the stationary member is stationary relative to the engine unit, and the engine unit is included in the outboard engine tiltable about a tilting axis, and the operating cable extending from an external position in front of the engine unit into the engine unit to transmit operating force applied to an operating member disposed outside the engine unit;

a shift rod for shifting a forward/backward gear included in a propulsion unit;

a driving member operatively connected to the shift rod to drive the shift rod; and a transmission mechanism linked to the operating cable to transmit the operating force to the driving member;

wherein the transmission mechanism includes an input member that receives the operating force from the operating cable, the operating cable is connected to the input member of the transmission mechanism by a linking member, a first connecting member connecting the input member and the linking member is nearer to the stationary member than a second connecting member connecting the operating cable and the linking member.

2. The forward/backward gear shifting mechanism according to claim 1, wherein a guide is formed in the engine unit to guide the linking member for sliding substantially parallel to the operating cable.

3. The forward/backward gear shifting mechanism according to claim 2, wherein the guide is formed in a bracket fixed to the engine unit.

4. The forward/backward gear shifting mechanism according to claim 1, wherein the input member is an input arm having a pivotal shaft having a fixed rotational axis and supported by support members on the engine unit.

5. A forward/backward gear shifting mechanism for an outboard engine, comprising:

an operating cable for transmitting operating force applied to an operating member disposed outside an engine unit included in the outboard engine;

a shift rod for shifting a forward/backward gear included in a propulsion unit;

a driving member operatively connected to the shift rod to drive the shift rod; and a transmission mechanism connected to the operating cable to transmit the operating force to the driving member;

wherein the transmission mechanism includes an arm mechanism pivotally supported on support members included in the engine unit for turning about a fixed rotation axis; and said driving member is a driving arm turnable with said shift rod about a center axis of the shift rod, and wherein said arm mechanism comprises:

an input arm linked to the operating cable; and an output arm connected with the input arm for turning together with the input arm about said fixed rotation axis, the output arm having a distal end thereof in engagement with a distal end of said driving arm whereby turning motion is transmitted from the output arm to the driving arm.

6. The forward/backward gear shifting mechanism according to claim 5, wherein the input arm and the operating cable are linked within the engine unit by a linking structure having a slot that enables the operating cable to move along a substantially straight line in a moving range corresponding to the turning range in which the input arm turns.

7. A forward/backward gear shifting mechanism for an outboard engine, comprising:

a shift rod for shifting a forward/backward gear included in a propulsion unit;

a neutral-indicating switch which detects shift of the forward/backward gear to a neutral position, said switch having an actuator; and a swinging operating arm mounted turnably about a rotational axis apart from said neutral-indicating switch and having at one end thereof a driven part which moves in connection with a shifting movement of the shift rod and at another end thereof a pressing part which acts on the actuator to move the same in opposite directions when the driven part is moved;

wherein the operating arm is disposed relative to said neutral-indicating switch such that an angle formed between a line extending in the moving directions of the actuator and a line connecting said rotational axis and a contact point between the actuator and the pressing part is in a range of 45 degrees and 135 degrees, so that a displacement of the pressing part in the moving directions of the actuator in a moving range in which the actuator moves is greater than a displacement of the same in a direction perpendicular to the moving directions in which the actuator moves as viewed in the direction in which the rotation axis is extended.

8. A forward/backward gear shifting mechanism for an outboard engine, comprising:

a shift rod to be driven by operating force to shift a forward/backward gear included in a propulsion unit;

a neutral-indicating switch which detects shift of the forward/backward gear to a neutral position, said switch having an actuator; and an operating member mounted turnably about a rotational axis apart from said neutral-indicating switch and having at one end thereof a driven part to be moved in connection with a shifting movement of the shift rod and at the other end thereof a pressing part which acts on the actuator to move the same in opposite directions when the driven part is moved;

a cam provided to move with movement of the shift rod to act on and move said driven part of the operating member in synchronism with the shifting movement of the shift rod;

a spring urging the operating member toward the cam; and a projection formed on one of said cam and said driven part of the operating member, the other of the cam and the operating member having a depression formed therein, said projection engaging said depression when the forward/backward gear is shifted to a neutral position.

9. The forward/backward gear shifting mechanism according to claim 8, wherein the operating member is a swingable operating arm, and the spring is on a boss formed on the operating arm.

10. The forward/backward gear shifting mechanism according to claim 8, wherein the projection is formed on the operating member and engages in the depression formed on the cam when the forward/backward gear is shifted to the neutral position.

11. A forward/backward gear shifting mechanism for an outboard engine capable of being tilted about a tilting axis and of being turned about a steering axis, comprising:

an operating cable for transmitting operating force applied to an operating member disposed outside an engine unit included in the outboard engine;

a shift rod for shifting a forward/backward gear included in a propulsion unit;

a driving member connected to the shift rod for turning together with the shift rod to drive the shift rod; and a transmission mechanism linked to the operating cable to transmit the operating force to the driving member;

wherein the transmission mechanism includes an input member linked to the operating cable, and an output arm linked to the driving member, the output arm is pivotally supported on support members on the engine unit for turning about a fixed rotational axis, the rotational axis is located nearer to a connecting member connecting the operating cable and the input member than to a reference plane including the steering axis and perpendicular to the tilting axis.

12. The forward/backward gear shifting mechanism according to claim 11, wherein an angle in a plane between a first half line extending from the rotational axis toward the axis of the shift rod and a second half line extending from the rotational axis toward a center axis of the connecting member is an inferior angle greater than 90° and the operating cable is extended from a position in front of the engine unit through an outer pipe fixed to a stationary member attached to the engine unit above the tilting axis and on the front side of the connecting member into the engine unit.

13. The forward/backward gear shifting mechanism according to claim 11, wherein the input member is an input arm connected to the output arm for turning together with the output arm, and the transmission mechanism is an arm mechanism including the input arm and the output arm.

14. The forward/backward gear shifting mechanism according to claim 12, wherein the angle in a plane between a first half line extending from the rotational axis toward the axis of the shift rod and a second half line extending from the rotational axis toward a center axis of the connecting member is an inferior angle greater than 180°.

15. A forward/backward gear shifting mechanism gear an outboard engine, comprising:

an operating cable passed through an outer pipe, the outer pipe fixed to a stationary member of an engine unit, where the stationary member is stationary relative to the engine unit, and the engine unit is included in the outboard engine tiltable about a tilting axis, and the operating cable extending from an external position in front of the engine unit into the engine unit to transmit operating force applied to an operating member disposed outside the engine unit;

a shift rod for shifting a forward/backward gear included in a propulsion unit;

a driving member operatively connected to the shift rod to drive the shift rod;

a transmission mechanism linked to the operating cable to transmit the operating force to the driving member;

a neutral-indicating switch having an actuator and capable of detecting shift of the forward/backward gear to a neutral position; and an operating member having a pressing part for moving the actuator in opposite directions;

wherein the transmission mechanism includes an input member that receives the operating force from the operating cable, the operating cable is connected to the input member of the transmission mechanism by a linking member, a first connecting member connecting the input member and the linking member is nearer to the stationary member than a second connecting member connecting the operating cable and the linking member, and wherein a cam operates the operating member in synchronism with the operation of the shift rod, a spring urges the operating member toward the cam, a projection formed on the operating member engages in a depression formed on the cam when the forward/backward gear is shifted to a neutral position.

16. The forward/backward gear shifting mechanism according to claim 15, wherein a guide is formed in the engine unit to guide the linking member for sliding substantially parallel to the operating cable, and wherein the guide is formed in a bracket fixed to the engine unit.

17. The forward/backward gear shifting mechanism according to claim 15, wherein the input member is an input arm having a pivotal shalt having a fixed rotational axis and supported by support members on the engine unit.

18. The forward/backward gear shifting mechanism according to claim 15, wherein the operating member is a swingable operating arm, and the spring is on a boss formed on the operating arm.

* * * * *

UNITED STATES PATENT AND TRADEMARK OFFICE

CERTIFICATE OF CORRECTION

PATENT NO. : 7,125,296 B2
APPLICATION NO. : 10/877069
DATED : October 24, 2006
INVENTOR(S) : Yazaki et al.

It is certified that error appears in the above-identified patent and that said Letters Patent is hereby corrected as shown below:

On the title page:

After "(75) Inventors:", change "Tsuyoshi Yoshigasa" to --Tsuyoshi Yoshigasaki--.

Signed and Sealed this

Eighteenth Day of March, 2008

JON W. DUDAS
*Director of the United States Patent and Trademark Office*